US005861853A

United States Patent [19]

Haub et al.

[11] Patent Number: 5,861,853

[45] Date of Patent: Jan. 19, 1999

[54] CURRENT BALANCED BALUN NETWORK WITH SELECTABLE PORT IMPEDANCES

[75] Inventors: David Ryan Haub, Graylake; Louis Jay Vannatta, Crystal Lake; Hugh Kennedy Smith, Palatine, all of Ill.

[73] Assignee: Motorola, Inc., Schaumburg, Ill.

[21] Appl. No.: 852,767

[22] Filed: May 7, 1997

[51] Int. Cl.[6] ..... H01Q 1/24; H01P 5/10

[52] U.S. Cl. ..... 343/702; 343/859; 333/26; 333/25

[58] Field of Search ..... 333/25, 26; 343/863, 343/864, 859, 702

[56] References Cited

U.S. PATENT DOCUMENTS

| | | | |
|---|---|---|---|
| 3,614,676 | 10/1971 | Boelke | 333/26 |
| 4,125,810 | 11/1978 | Pavio | 333/26 X |
| 4,350,958 | 9/1982 | Pagnamenta | 330/286 |
| 4,355,421 | 10/1982 | Seely | 333/26 X |
| 4,431,977 | 2/1984 | Sokola et al. | 333/206 |
| 4,460,877 | 7/1984 | Sterns | 333/26 |
| 4,717,896 | 1/1988 | Graham | 333/25 |
| 4,739,289 | 4/1988 | Cripps | 333/26 |
| 4,800,344 | 1/1989 | Graham | 333/25 |
| 5,014,346 | 5/1991 | Phillips et al. | 455/89 |
| 5,172,082 | 12/1992 | Livingston et al. | 333/26 |
| 5,202,654 | 4/1993 | Heine | 333/206 |
| 5,565,881 | 10/1996 | Phillips et al. | 333/26 X |
| 5,628,057 | 5/1997 | Phillips et al. | 333/26 X |
| 5,705,960 | 1/1998 | Izumiyama | 333/26 |

FOREIGN PATENT DOCUMENTS 59-148405A 8/1984 Japan .

*Primary Examiner*—Seungsook Ham
*Attorney, Agent, or Firm*—Daniel W. Juffernbruch

[57] ABSTRACT

A half-wave balun network balanced for at least current is provided by a conductor section having contiguous conductor portions 130 and 140. A balanced port 110 is provided between ends of the conductor section. An unbalanced port 120 is provided between one end of the conductor section and a ground plane 107. A difference between impedances of the contiguous conductor portions 130 and 140 of the half-wave balun network provides for a selectable impedance ratio between the port impedances of the balanced and unbalanced ports 110 and 120. In one embodiment the number of different impedance conductor portions approaches infinity, thereby providing a tapered conductor section.

12 Claims, 2 Drawing Sheets

CURRENT BALANCED BALUN NETWORK WITH SELECTABLE PORT IMPEDANCES

BACKGROUND OF THE INVENTION

1. Technical Field of the Invention

The present invention relates to balun networks, and more particularly, relates to balun networks having selectable port impedances.

2. Description of the Related Art

Radio designers typically chooses components and feed lines having standard impedances such as 300 Ohms, 75 Ohms, or 50 Ohms, for example. Such standard impedances match the impedances of existing standard components. These include balanced-unbalanced networks or balun networks. Known balun networks have fixed impedance ratios between the balanced and unbalanced inputs and outputs. For example, most baluns such as split sheath and bazooka baluns have impedance ratios of 1:1. Thus, the input impedance is the same as the output impedance. Other baluns such as a half-wave balun has an impedance ratio of 4:1, wherein the balanced port has an impedance four times the impedance of the unbalanced port.

Radio frequency functions have been implemented in integrated circuit chips. Many integrated circuit chips have balanced connections while other components on a printed circuit board require unbalanced connections. Implementing baluns with fixed impedance ratios for coupling to standard impedances of radio frequency components places an impedance requirement constraint on the design of an integrated circuit.

DESCRIPTIONS OF THE PREFERRED EMBODIMENTS

Figure 1:
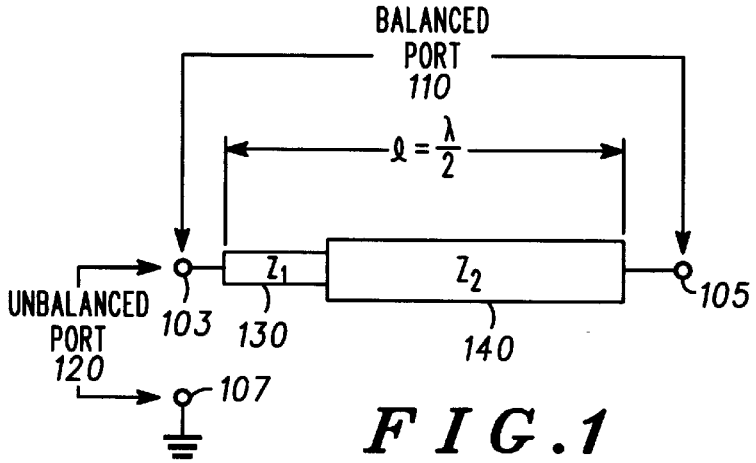
FIG. 1 illustrates a balun network according to a first embodiment.

A balun network having a selectively variable impedance ratio between a balanced port 110 and an unbalanced port 120 is illustrated in FIG. 1 according to a first embodiment. The balun network has a conductor section of at least two contiguous portions 130 and 140. An entire length 1 of the line made up of the first and second portions 130 and 140 has a length an odd integral multiple of about one-half a wavelength of a nominal frequency of interest. The balanced port 110 connects between a first end 103 and a second end 105 of the conductor section, e.g., the first and second conductor portions 130 and 140. The unbalanced port 120 connects between the first end 103 and a ground plane or ground 107 of the unbalanced port 120.

The first conductor portion 130 has an impedance $Z_1$, and the second portion 140 has an impedance $Z_2$ different than the impedance $Z_1$ of the first portion. By providing different portions of different impedances, a half-wave balun network is provided having ports with selectively varying impedances. For example, if the impedance $Z_2$, of the first portion 130 is 45 Ohms and the impedance $Z_2$ of the second portion 140 is 60 Ohms, then the balanced port 110 has an impedance of 272.333 Ohms and the unbalanced port 120 has an impedance of 50 Ohms. As this impedance difference between the conductor portions 130 and 140 changes, the ratio of impedances can be increased or lowered between the balanced and unbalanced ports 110 and 120. It has been found that the balun network of the present invention can achieve selectable impedance ratios of up to about 9:1 or down to roughly 2:1 and values in between.

In a previous balun with a single conductor section of a constant impedance, however, for example, the balun network has an expected impedance ratio between the balanced port and unbalanced port of 4:1. Thus, the balanced port 110 would have an impedance of 200 Ohms and the unbalanced port 120 would have an impedance of 50 Ohms when the conductor portion had a constant impedance across its half wave length.

The balun network of the present invention is balanced for at least current. As the impedances of portions of the half-wave section are changed, the voltage has been found to be unbalanced at each of the terminals of the balanced port when measured with respect to the ground plane or ground 107.

Figure 2:
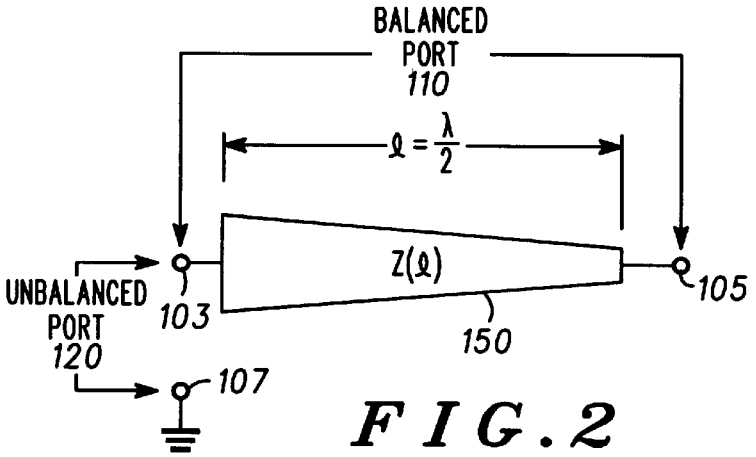
FIG. 2 illustrates a balun network according to a second embodiment.

FIG. 2 illustrates a tapered conductor section 150 having a varying impedance Z(1) which varies according to a position at any given point along the length of the conductor. Because more than two different impedance conductor portions can be provided to adjust the ratios between the ports, the tapered shaped conductor section 150 of the embodiment of FIG. 2 illustrates a number of conductor portions approaching infinity. The number of different impedance portions can thus vary from two up to infinity. The tapered conductor section 150 has likewise been shown by simulation to provide a variable impedance at the balanced and unbalanced ports dependent upon the impedances chosen along the lengths of the conductor.

The balanced port 110 connects between a first end 103 and second end 105 of the tapered conductor section 150, and the unbalanced port 120 connects between the first end 103 and a ground plane or ground 107 of the unbalanced port.

Figure 3:
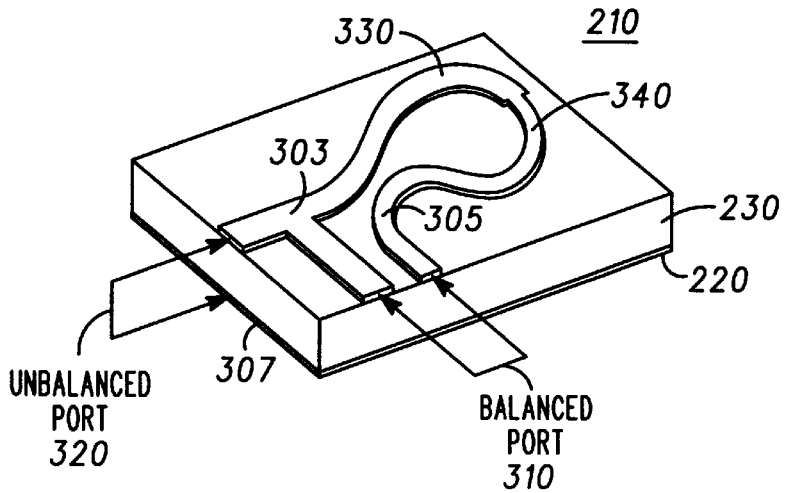
FIG. 3 illustrates a balun according to a third embodiment.

FIG. 3 illustrates an exemplary construction of the balun network on a printed circuit board 210. The printed circuit board 210 has a metalized underside 220 on the same plane of a surface of a dielectric substrate of the board 230. Elongated metallic strips are placed on an upper-side of the dielectric board 230. The elongated metallic strips form a first conductor portion 330 of a first impedance and a second conductor portion 340 of a second impedance different than the first impedance. This is achieved by varying the width of the elongated metallic strip on the dielectric board 230 of the printed circuit board. The first conductor portion 330 and the second portion 340 of FIG. 3 has a U-shaped configuration which loops backwardly at its electrical midpoint and is symmetric along a center line between the two conductor portions.

A balanced port 310 is provided between a first end 303 and second end 305 of the first conductor portion 330 and the second conductor portion 340. An unbalanced port 320 is provided between the first end 303 of the conductor portion and the ground plane or ground 307 of the unbalanced port 320. In the printed circuit embodiment having a metalized under-surface 220 of the embodiment of FIG. 3, the ground plane of the unbalanced port 320 is the same as the metal layer 220.

Figure 4:
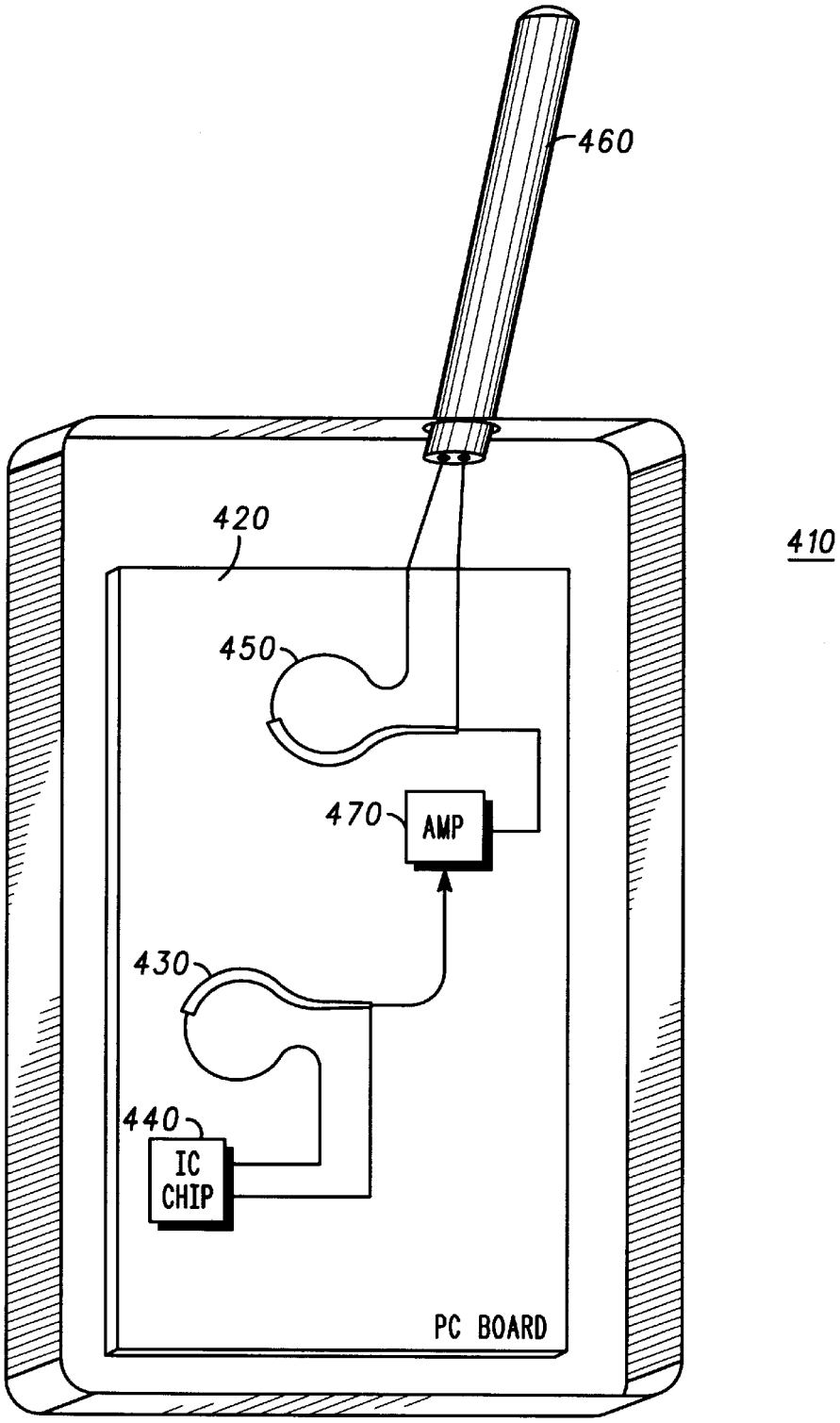
FIG. 4 illustrates a radio having a printed circuit board sharing a balun network and components.

FIG. 4 illustrates a portable radio 410 with a cutaway view of a printed circuit board 420 therein. The printed circuit board 420 has a balun network 430 plated thereon for connection to an integrated circuit chip 440. The printed circuit board 420 also has another balun network 450 coupled between an antenna 460 and an amplifier 470 of radio transceiver circuitry. By placing the balun network having a selectable impedance ratio according to the present invention on a printed circuit board, the selectable impedance ratio between the balanced and unbalanced ports 103, 105 of the balun network provides for greater flexibility when choosing and designing components, such as the integrated circuit chip 440, the radio transceiver circuitry, and the antenna 460. Existing components of fixed impedances are of lesser importance with the variable impedance balun of the present invention.

Although the invention has been described and illustrated in the above description and drawings, it is understood that this description is by example only and that numerous changes and modifications can be made by those skilled in the art without departing from the true spirit and scope of the invention. The present invention is applicable to devices needing a balun requiring current balance. These include radios for cellular, paging, satellite and land mobile products. More flexible provision of integrated circuit chips in these and other devices is also achieved. Besides provision on a printed circuit board in a strip line or microstrip configuration, the balun network can also be implemented using plated dielectric blocks having holes or other conductive structures formed therein with ground planes selectively plated thereon.

What is claimed is:

1. A balun network balanced for at least current, comprising a conductor section having first and second ends and at least two contiguous conductor portions therebetween;

a balanced port between the first end of the conductor section and the second end of the conductor section;

an unbalanced port between a ground reference plane and the first end of the conductor section; and wherein the at least two contiguous conductor portions have impedances different from one another to provide for a selected impedance value at the balanced and unbalanced ports.

2. A balun network according to claim 1, wherein the number of contiguous conductor portions approaches infinity and the conductor section thereby has a tapered shape.

3. A balun network according to claim 1, wherein the conductor section has a U shaped configuration made of a plurality of contiguous conductor portions of different impedances.

4. A balun network according to claim 1, further comprising an integrated circuit having a connection port thereto operatively coupled to one of the balanced port and the unbalanced port.

5. A balun network according to claim 1, wherein a ratio of the impedances of the balanced and unbalanced ports is dependent on the relative impedances of the at least two conductor portions.

6. A balun network according to claim 1, wherein the first and second conductor portions occupy a same plane.

7. A balun network according to claim 1, wherein the ground reference plane consists of a feed line ground conductor.

8. A balun network according to claim 1, wherein the ground reference plane comprises a feed line ground conductor and a plane adjacent to the conductor section.

9. A balun network according to claim 1, wherein the conductor section has a length an odd integral multiple of about one-half of a wavelength of a frequency of interest.

10. A balun network according to claim 1, wherein the conductor section is formed by at least one elongated metallic strip on a dielectric surface.

11. A portable radio, comprising:

radio transceiver circuitry for providing an unbalanced connection;

a balun comprising a conductor section having first and second ends and at least two contiguous conductor portions therebetween, an unbalanced port between a ground reference plane and the first end of the conductor section and operatively coupled to the unbalanced connection of the radio transceiver circuitry, wherein the at least two contiguous conductor portions have impedances different from one another to provide for a selected impedance value at the balanced and unbalanced ports, and an integrated circuit including a balanced connection, one conductor of the balanced connection of the integrated circuit connected to the first end of the conductor section and wherein another conductor of the balanced connection of the integrated circuit is connected to the second end of the conductor section.

12. A portable radio, comprising:

radio transceiver circuitry for providing an unbalanced output;

a balun comprising a conductor section having first and second ends and at least two contiguous conductor portions therebetween, an unbalanced port between a ground reference plane and the first end of the conductor section and operatively coupled to the unbalanced output of the radio transceiver circuitry, wherein the at least two contiguous conductor portions have impedances different from one another to provide for a selected impedance value at the balanced and unbalanced ports, and an antenna element including a balanced antenna port, one conductor of the balanced antenna port of the antenna element connected to the first end of the conductor section and wherein another conductor of the balanced port of the antenna element is connected to the second end of the conductor section.

* * * * *